US009440256B2

(12) United States Patent
Tabayashi

(10) Patent No.: US 9,440,256 B2
(45) Date of Patent: Sep. 13, 2016

(54) METHOD FOR PRODUCING LAMINATE INCLUDING METALLIC INK LAYER

(71) Applicant: MIMAKI ENGINEERING CO., LTD., Nagano (JP)

(72) Inventor: Isao Tabayashi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/505,497

(22) Filed: Oct. 3, 2014

(65) Prior Publication Data

US 2015/0097904 A1 Apr. 9, 2015

(30) Foreign Application Priority Data

Oct. 7, 2013 (JP) ..... 2013-210578

(51) Int. Cl.
*B05D 5/06* (2006.01)
*B41M 7/00* (2006.01)
*B05D 3/06* (2006.01)

(52) U.S. Cl.
CPC ..... *B05D 5/068* (2013.01); *B05D 3/067* (2013.01); *B41M 7/0081* (2013.01)

(58) Field of Classification Search
CPC ..... B05D 5/068; B05D 3/067; B41M 7/0081
USPC ..... 347/101, 102, 105
See application file for complete search history.

(56) References Cited

U.S. PATENT DOCUMENTS 6,868,885 B2 * 3/2005 Kakimoto ..... B32B 37/24 118/314
7,993,820 B2 * 8/2011 Inoue ..... H01L 51/0012 118/211
2012/0120168 A1 * 5/2012 Kachi ..... B41J 11/002 347/102

FOREIGN PATENT DOCUMENTS

CN 102358087 2/2012
JP 2013-001839 1/2013
WO 2012111242 8/2012

OTHER PUBLICATIONS

Office Action of China Counterpart Application with English translation, issued on May 27, 2016, p. 1-p. 14.

* cited by examiner

*Primary Examiner* — Henok Legesse
(74) *Attorney, Agent, or Firm* — Jianq Chyun IP Office

(57) ABSTRACT

A laminate is provided that includes a metallic ink layer having excellent glossiness. A method for producing a laminate includes forming a metallic ink layer by irradiating ultraviolet light to a metallic ink applied onto a medium, forming a smoothing ink layer by applying a smoothing ink onto the metallic ink layer after forming the metallic ink layer, and forming a color ink layer by applying a color ink onto the smoothing ink layer.

12 Claims, 1 Drawing Sheet

METHOD FOR PRODUCING LAMINATE INCLUDING METALLIC INK LAYER

CROSS REFERENCE TO RELATED APPLICATIONS

This application claims the priority benefit of Japanese application serial no. 2013-210578, filed on Oct. 7, 2013. The entirety of the above-mentioned patent application is hereby incorporated by reference herein and made a part of this specification.

TECHNICAL FIELD

The present invention relates to a method for producing a laminate that includes a metallic ink layer.

DESCRIPTION OF THE BACKGROUND ART

JP-A-2013-001839 (Patent Literature 1, published on Jan. 7, 2013) describes a UV curable inkjet composition that contains a metal powder and a solvent.

An ink containing the UV curable inkjet composition described in Patent Literature 1 is ejected onto a medium to form a metallic ink layer, and a color ink for imparting a color is ejected onto the metallic ink layer to form a color ink layer. In this way, a printed matter (laminate) with a metallic color image can be obtained. However, the metallic ink layer of the printed matter is not sufficient in terms of glossiness, and there is a need for a method that can produce a printed matter that excels in glossiness.

SUMMARY

The present invention has been made in view of the foregoing problem, and it is an object of the present invention to provide a method for producing a laminate having a metallic ink layer that excels in glossiness.

As a solution to the foregoing problem, a laminate producing method according to an aspect of the present invention is a method for producing a laminate by laminating a recording medium, a metallic ink layer formed of a UV curable metallic ink containing metal particles, a smoothing ink layer formed of a smoothing ink that smoothes surface irregularities of at least one of the recording medium and the metallic ink layer, and a color ink layer formed of a color ink, and the method including:

a metallic ink layer forming step of applying the metallic ink onto the recording medium or the smoothing ink layer formed on the recording medium, and curing the metallic ink by irradiation of ultraviolet light and forming the metallic ink layer;

at least one of a smoothing ink layer forming step I of forming the smoothing ink layer by applying the smoothing ink onto the recording medium before the metallic ink layer forming step, and a smoothing ink layer forming step II of forming the smoothing ink layer by applying the smoothing ink onto the metallic ink layer after the metallic ink layer forming step; and a color ink layer forming step of forming the color ink layer by applying the color ink onto the smoothing ink layer or the metallic ink layer formed on the smoothing ink layer.

In the smoothing ink layer forming step I, the smoothing ink is applied onto the recording medium to form the smoothing ink layer. The metallic ink is then applied onto the smoothing ink layer to form the metallic ink layer. Here, the metallic ink layer is formed on the smoothed surface of the smoothing ink layer, and the smoothing ink layer provides a seal, preventing the metallic ink from permeating into the surface of the recording medium. Further, because the metallic ink layer is formed on the smoothed surface of the smoothing ink layer, the metallic ink layer can have reduced surface irregularities. The present invention can thus provide a laminate having a metallic ink layer of excellent glossiness that can suppress the diffuse reflection at the metallic ink layer surface.

In the smoothing ink layer forming step II, the smoothing ink is applied onto the metallic ink layer to form the smoothing ink layer. The metallic ink layer has surface irregularities before the smoothing ink application. However, the smoothing ink is applied to the surface in a manner that allows the smoothing ink layer to fill the irregularities. Specifically, the smoothing ink layer is provided between the irregular surface of the metallic ink layer and the color ink layer, instead of providing the color ink layer in direct contact with the surface of the metallic ink layer having irregularities. The present invention can thus provide a laminate having a metallic ink layer of excellent glossiness that can suppress the diffuse reflection at the ink layer interface.

The laminate having the metallic ink layer of excellent glossiness can be produced with at least one of the smoothing ink layer forming step I and the smoothing ink layer forming step II.

It is preferable in the producing method according to the aspect of the present invention that the metallic ink be cured by irradiation of ultraviolet light while being applied.

With this configuration, the metallic ink layer can be formed in a short time period by applying and curing the metallic ink at the same time.

It is preferable in the producing method according to the aspect of the present invention that the metallic ink contain a solvent.

The solvent enables regulating the movement of the metal particles contained in the metallic ink, and forming a thin metallic ink layer. Further, because of the high fluidity before the curing of the metallic ink, the metal particles orderly align themselves. This makes it possible to form a metallic ink layer of further improved glossiness.

It is preferable in the producing method according to the aspect of the present invention that the smoothing ink be UV curable, and that, in the smoothing ink layer forming step I or the smoothing ink layer forming step II, the smoothing ink be cured by irradiation of ultraviolet light after being leveled.

By leveling the smoothing ink, the smoothing ink layer can have reduced surface irregularities. The irregularities of the metallic ink layer formed on the smoothing ink layer formed in the smoothing ink layer forming step I also can be reduced to further suppress the diffuse reflection at the metallic ink layer surface. The smoothing ink layer formed on the metallic ink layer in the smoothing ink forming step II also has reduced irregularities, and can further suppress the diffuse reflection at the ink layer interface.

It is preferable in the producing method according to the aspect of the present invention that the smoothing ink be a transparent clear ink.

With the use of a transparent clear ink, the color of the ink does not bleed even when left unattended. Further, the diffuse reflection at the surface of the smoothing ink layer can be suppressed even more desirably.

It is preferable in the producing method according to the aspect of the present invention that the smoothing ink contain a solvent.

The solvent can improve the fluidity of the smoothing ink, and allows the smoothing ink to be easily applied to the recording medium or the metallic ink layer.

The laminate producing method according to the aspect of the present invention can advantageously produce a laminate having a metallic ink layer that excels in glossiness.

DESCRIPTION OF EXEMPLARY EMBODIMENTS

First Embodiment

Figure 1A:
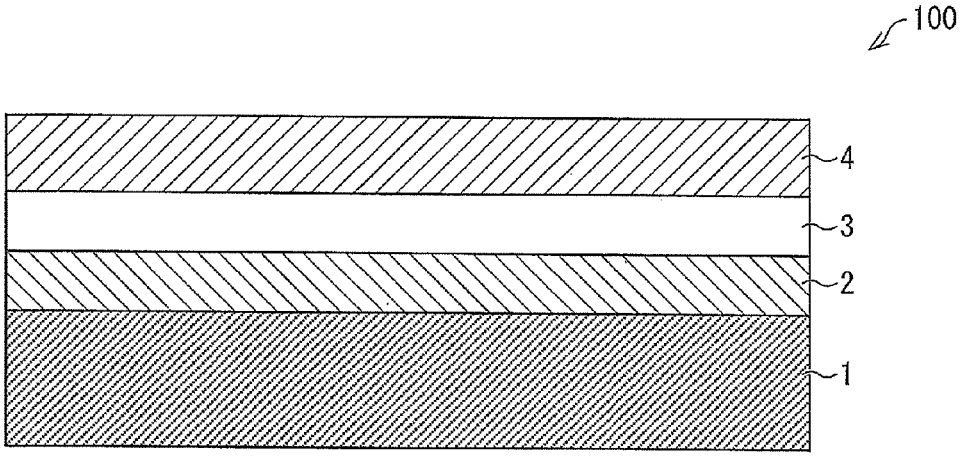
FIGS. 1A to 1C are diagrams representing the structures of the laminates of embodiments of the present invention.
Figure 1B:
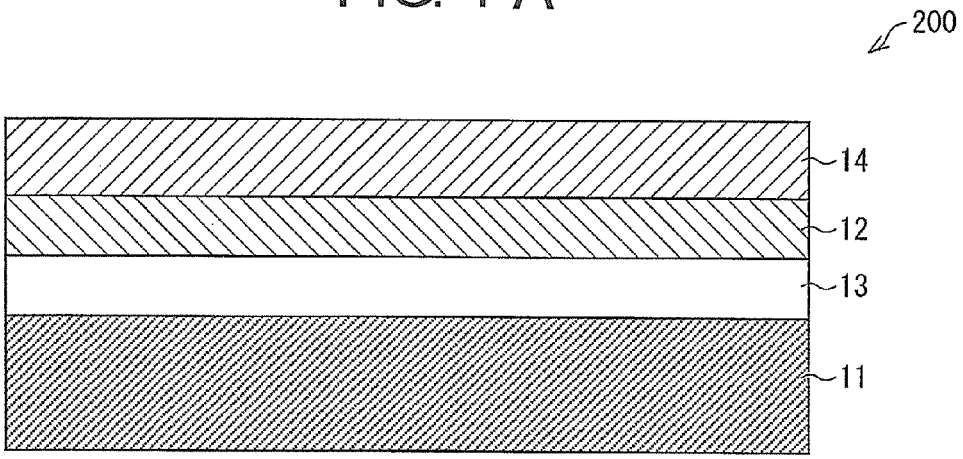
Figure 1C:
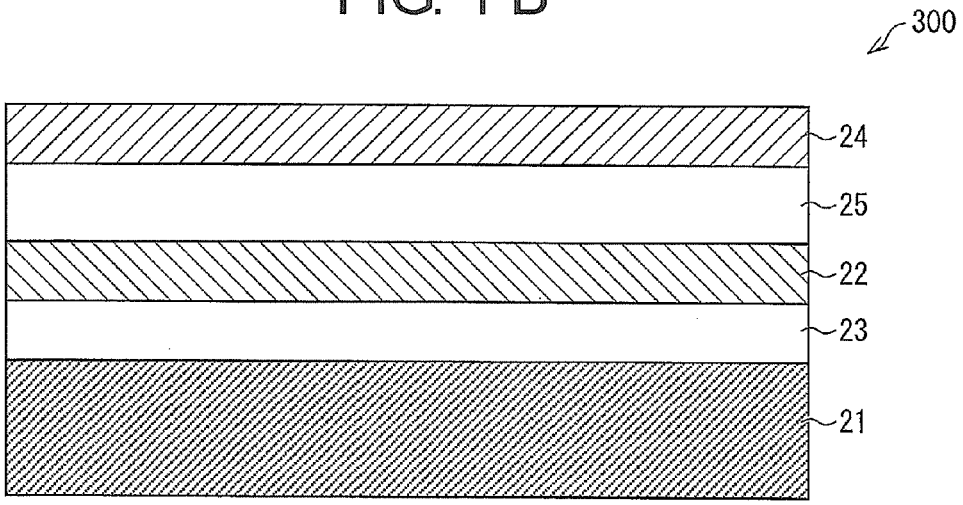

The First Embodiment of the present invention is described below with reference to FIGS. 1A to 1C. FIGS. 1A to 1C are diagrams representing the structures of the laminates of embodiments of the present invention. The following description specifically describes a laminate 100 produced by using the laminate producing method according to the present embodiment, and the configuration of each element forming the laminate 100.

Laminate

As illustrated in FIG. 1A, the laminate 100 according to the present embodiment includes a medium (recording medium) 1, a metallic ink layer 2, a smoothing ink layer 3, and a color ink layer 4, laminated in this order.

Recording Medium

The medium 1 is a printing target on which ink layers, including the metallic ink layer 2, the smoothing ink layer 3, and the color ink layer 4 are formed. The medium 1 is not particularly limited, and may be selected according to the intended use, as long as the ink layers can be formed thereon. Examples of the medium 1 include a plate-like member, a sheet-like member, and a web-like member, more specifically, paper, plastic sheets, labels, fibers, and nonwoven fabrics.

Metallic Ink Layer

The metallic ink layer 2 is formed upon UV curing of the metallic ink applied onto the medium 1.

The metallic ink is an ink that contains at least a UV curable compound that cures upon UV irradiation, and metal particles.

UV Curable Compound

The UV curable compound contained in the metallic ink is not limited, as long as it is a compound that cures upon UV irradiation. Examples of the UV curable compound include curable monomers and curable oligomers that polymerize upon UV irradiation.

Examples of such curable monomers include low-viscosity acryl monomers, vinyl ethers, oxetane monomers, or alicyclic epoxy monomers. Examples of the curable oligomers include acrylic oligomers.

The low-viscosity acryl monomers undergo radical polymerization and form a cured resin. Examples of the low-viscosity acryl monomers include methoxypolyethylene glycol (n=3 or 9) acrylate, phenoxyethylene glycol acrylate, phenoxydiethylene glycol acrylate, phenoxyhexaethylene glycol acrylate, methoxypolyethylene glycol (n=2, 4, or 9) methacrylate, 3-chloro-2-hydroxypropyl methacrylate, β-carboxyethyl acrylate, acryloyl morpholine, diacetone acrylamide, vinyl formamide, N-vinyl pyrrolidone, neopentyl glycol dimethacrylate, 2 PO neopentyl glycol dimethacrylate, polyethylene glycol (n=4 or 9) diacrylate, ethylene glycol dimethacrylate, nonaethylene glycol dimethacrylate, polypropylene glycol (n=2, 4, or 9) diacrylate, tetraethylene glycol diacrylate, glycerine dimethacrylate, glycerine acrylate methacrylate, modified epoxidized polyethylene glycol diacrylate, 2-(2-vinyloxyethoxy) ethyl acrylate, ethoxylated trimethylolpropane triacrylate, ethoxylated glycerine triacrylate (20 moles EO), or EO modified trimethylolpropane triacrylate.

The vinyl ethers undergo cationic polymerization and form a cured resin. Examples of the vinyl ethers include hydroxybutyl vinyl ether, triethylene glycol divinyl ether, cyclohexane dimethanol divinyl ether, propenyl ethers of propylene carbonate, dodecyl vinyl ether, cyclohexane dimethanol monovinyl ether, cyclohexane vinyl ether, diethylene glycol divinyl ether, diethylene glycol divinyl ether, 2-ethylhexyl vinyl ether, dipropylene glycol divinyl ether, tripropylene glycol divinyl ether, hexanediol divinyl ether, octadecyl vinyl ether, butanediol divinyl ether, isopropyl vinyl ether, allyl vinyl ether, 1,4-butanediol divinyl ether, nonadiol divinyl ether, cyclohexanediol vinyl ether, cyclohexane dimethanol vinyl ether, triethylene glycol divinyl ether, trimethylolpropane trivinyl ether, pentaerythritol tetravinyl ether, 2-(2-vinyloxyethoxy) ethyl acrylate, or 2-(2-vinyloxyethoxy) ethyl methacrylate. Examples of the vinyl ether curable monomers include the monomers represented by the following chemical formulae (I) or (II).

(I)

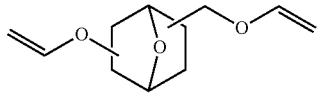

(II)

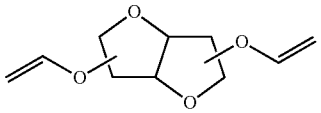

The oxetane monomers undergo cationic polymerization and form a cured resin. Examples of the oxetane monomers include 3-ethyl-3-hydroxymethyloxetane, 1,4-bis[((3-ethyloxetan-3-yl)methoxy)methyl]benzene, 3-ethyl-3-[((3-ethyloxetan-3-yl)methoxy)methyl]oxetane, 3-ethyl-3-(2-ethylhexyloxymethyl)oxetane, or 3-ethyl-3-(phenoxymethyl) oxetane.

The alicyclic epoxy monomers undergo cationic polymerization and form a cured resin. Examples of the alicyclic epoxy monomers include Celloxide 2000, and Celloxide 3000 (Daicel Chemical Industries Co., Ltd.), CYRACURE UVR-6015, CYRACURE UVR-6028, CYRACURE UVR-6105, CYRACURE UVR-6128, CYRACURE ERL-4140 (Dow Chemical Co.), and derivatives thereof, and DCPD-EP (Maruzen Petrochemical Co., Ltd.), and derivatives thereof.

The acrylic oligomers undergo cationic polymerization and form a cured resin. Examples of the acrylic oligomers include hyper branched polyester acrylate, polyester acrylate, urethane acrylate, or epoxy acrylate.

The content of the UV curable compound in the metallic ink is preferably 1 weight % to 90 weight %, more preferably 5 weight % to 60 weight % with respect to the total ink.

Metal Particles

The metal particles represent a colorant contained in the metallic ink, and that provides the metallic texture to the laminate. The type of metal may be appropriately selected according to the intended use of the laminate, and may be, for example, silver or aluminum. The metal particles may be particles with the metal existing on particle surface, and encompass particles of solely metal, and nonmetal particles coated with metal on the surface.

The particle diameter of the metal particles is preferably 0.2 μm to 10 μm, more preferably 0.5 μm to 5 μm along the major axis. The minor axis and the thickness are smaller than the major axis, and are preferably ⅕ or less of the major axis.

The shape of the metal particles contained in the metallic ink is not particularly limited, and the metal particles may have, for example, a flake or a flat shape. By making flake- or flat-shaped metal particles align themselves with their plane direction being parallel to the plane direction of the recording medium, the luminance can be further improved.

The content of the metal particles in the metallic ink is preferably 1 weight % to 20 weight %, more preferably 2 weight % to 10 weight % with respect to the total ink.

Solvent

The metallic ink may contain a solvent, in addition to the UV curable compound and the metal particles. Ejection stability and preservation stability are improved when the metallic ink contains a solvent. It is also possible with the solvent to regulate the movement of the metal particles contained in the metallic ink applied to the medium 1, and form a thin metallic ink layer 2. Further, because of the high fluidity before the curing of the metallic ink, the metal particles orderly align themselves. This makes it possible to form a metallic ink layer 2 of improved glossiness.

Examples of the solvent contained in the metallic ink include hydrocarbon solvents, alcohols, ester solvents, ether solvents, ketone solvents, or glycol derivatives.

Examples of the glycol derivatives include glycol ethers and glycol ether acetates, such as propylene glycol monomethyl ether, ethylene glycol monomethyl ether acetate, ethylene glycol monoethyl ether acetate, ethylene glycol monobutyl ether acetate, diethylene glycol monomethyl ether acetate, diethylene glycol monoethyl ether acetate, diethylene glycol monobutyl ether acetate, propylene glycol monomethyl ether acetate, dipropylene glycol monomethyl ether acetate, ethylene glycol monomethyl ether propionate, ethylene glycol monoethyl ether propionate, ethylene glycol monobutyl ether propionate, diethylene glycol monomethyl ether propionate, diethylene glycol monoethyl ether propionate, diethylene glycol monobutyl ether propionate, propylene glycol monomethyl ether propionate, dipropylene glycol monomethyl ether propionate, ethylene glycol monomethyl ether butyrate, ethylene glycol monoethyl ether butyrate, ethylene glycol monobutyl ether butyrate, diethylene glycol monomethyl ether butyrate, diethylene glycol monoethyl ether butyrate, diethylene glycol monobutyl ether butyrate, propylene glycol monomethyl ether butyrate, or dipropylene glycol monomethyl ether butyrate.

Examples of the hydrocarbon solvents include aromatic hydrocarbon solvents, chlorohydrocarbon solvents, alicyclic hydrocarbon solvents, or aliphatic hydrocarbon solvents. Specific examples include n-hexane, n-heptane, n-octane, isooctane, cyclohexane, methyl cyclohexane, benzene, toluene, o-xylene, m-xylene, p-xylene, or ethyl benzene.

Examples of the ester solvents include propyl formate, n-butyl formate, isobutyl formate, amyl formate, ethyl acetate, n-propyl acetate, isopropyl acetate, n-butyl acetate, isobutyl acetate, sec-butyl acetate, n-amyl acetate, isoamyl acetate, methyl isoamyl acetate, sec-hexyl acetate, methyl propionate, ethyl propionate, n-butyl propionate, methyl butyrate, ethyl butyrate, methyl lactate, or γ-butyrolactone.

The solvent contained in the metallic ink may be a ketone solvent. Examples of the ketone solvent include methyl ethyl ketone, methyl-n-propyl ketone, methyl-n-butyl ketone, methyl isobutyl ketone, diethyl ketone, ethyl-n-butyl ketone, di-n-propyl ketone, or mesityl oxide.

The content of the solvent in the metallic ink is preferably 10 weight % to 90 weight %, more preferably 40 weight % to 80 weight % with respect to the total ink.

Other Components

The metallic ink may contain components other than the UV curable compound, the metal particles, and the solvent, provided that such addition is not detrimental to the properties of the metallic ink. Examples of such other components include various additives, such as photopolymerization initiators, leveling agents, dispersants, permeation promoting agents, moisturizers, fixing agents, mildew-proofing agents, preservatives, antioxidants, chelating agents, thickeners, sensitizers (sensitizing dyes), stabilizers, colorants (other than the metal particles), antisettling agents, or light stabilizers. Examples of the light stabilizers include hindered amine light stabilizers.

The photopolymerization initiators are not particularly limited, as long as it can generate active species such as radicals and cations upon UV irradiation, and initiate a polymerization reaction of the polymerizable compound. Examples of the photopolymerization initiators include photo radical polymerization initiators, or photo cationic polymerization initiators. Preferred for use are photo radical polymerization initiators. When using a photopolymerization initiator, the photopolymerization initiator preferably has an absorption peak in the ultraviolet region.

Smoothing Ink Layer

The smoothing ink layer 3 is a layer formed on the metallic ink layer 2 to smooth the surface irregularities of the metallic ink layer 2. The smoothing ink layer 3 is formed by applying a smoothing ink to the surface of the metallic ink layer 2, and as required, irradiating the ink with ultraviolet light.

Preferably, the smoothing ink is an ink containing a UV curable compound. In this way, the smoothing ink can cure upon being irradiated with ultraviolet light. The UV curable compound contained in the smoothing ink may be the same UV curable compound contained in the metallic ink.

Preferably, the smoothing ink is a transparent clear ink. With a transparent clear ink, the diffuse reflection at the surface of the smoothing ink layer can be more desirably suppressed. The transparent clear ink is not particularly limited, and various types of transparent clear inks may be used.

Solvent

Preferably, the smoothing ink is an ink containing a solvent. Containing a solvent in the smoothing ink improves the fluidity of the smoothing ink, and allows the smoothing ink to be more easily applied to the recording medium or the metallic ink layer. The solvent may be the same solvent contained in the metallic ink.

The solvent content in the smoothing ink is preferably 5 weight % to 80 weight %, more preferably 10 weight % to 50 weight % with respect to the total ink.

Other Components

The smoothing ink may contain components other than the UV curable compound and the solvent, provided that such addition is not detrimental to the properties of the smoothing ink. Such additives contained in the smoothing ink may be the same additives contained in the metallic ink.

Color Ink Layer

The color ink layer 4 is a layer formed by applying a color ink onto the smoothing ink layer 3. Preferred for use as the color ink is, for example, a magenta, a cyan, or a yellow ink. The color ink may be, for example, a white ink containing a white pigment such as titanium oxide particles.

Preferably, the color ink is an ink containing a UV curable compound, as with the case of the metallic ink or the smoothing ink. In this way, the color ink can cure upon being irradiated with ultraviolet light.

Preferably, the color ink is an ink containing a solvent. The color ink may also contain other components, provided that such addition is not detrimental to the properties of the color ink, as with the case of the metallic ink and the smoothing ink.

Laminate Producing Method

The following description describes a method for producing the laminate 100 that includes the medium 1, the metallic ink layer 2, the smoothing ink layer 3, and the color ink layer 4, laminated in this order as shown in FIG. 1A.

Metallic Ink Layer Forming Step

First, the metallic ink is applied onto the medium 1, and is cured by irradiation of ultraviolet light. This forms the metallic ink layer 2 on the medium 1. The method used to apply the metallic ink is not particularly limited, and the metallic ink may be applied (ejected) by using an inkjet technique.

In the metallic ink layer forming step, the metallic ink may be cured by UV irradiation while being applied. The metallic ink layer 2 can be formed in a short time period by applying and curing the metallic ink at the same time.

When the metallic ink contains a solvent, it is preferable to UV irradiate the metallic ink as soon as the metallic ink is applied to the medium 1. This makes it possible to suppress the solvent permeation and bleeding into the medium 1. The metallic ink applied to the medium 1 may be heated with a heater or the like to evaporate the solvent.

The medium 1 has surface irregularities, and the metallic ink applied to the surface of the medium 1 forms the metallic ink layer 2 with surface irregularities. This is problematic because it causes diffuse reflection at the surface of the metallic ink layer 2, and lowers luminance when the color ink layer 4 is directly formed on the surface of the metallic ink layer 2.

Smoothing Ink Layer Forming Step

The metallic ink layer forming step is followed by applying the smoothing ink onto the metallic ink layer 2 and forming the smoothing ink layer 3 (smoothing ink layer forming step II). The smoothing ink is applied to fill the irregularities that are present on the surface of the metallic ink layer 2 before smoothing ink application.

In this step, the smoothing ink applied onto the metallic ink layer 2 is allowed a time to flow on the surface of the metallic ink layer 2. This levels the smoothing ink on the surface of the metallic ink layer 2 having irregularities.

After leveling the smoothing ink, the smoothing ink is UV cured to form the smoothing ink layer 3. This forms the smoothing ink layer 3 having reduced surface irregularities. The leveling time of the smoothing ink may be appropriately decided according to the viscosity of the smoothing ink. The UV intensity, and the duration of UV irradiation also may be appropriately decided according to the properties of the smoothing ink.

Color Ink layer Forming Step

The color ink layer 4 is formed by applying the color ink onto the smoothing ink layer 3 formed on the metallic ink layer 2. This completes the laminate 100 having the medium 1, the metallic ink layer 2, the smoothing ink layer 3, and the color ink layer 4 laminated in this order as shown in FIG. 1A.

In the present embodiment, the smoothing ink layer 3 is formed by applying the smoothing ink onto the metallic ink layer 2 in the smoothing ink layer forming step II. The smoothing ink layer 3 is formed between the irregular surface of the metallic ink layer 2 and the color ink layer 4, instead of providing the color ink layer 4 in direct contact with the surface of the metallic ink layer 2 having irregularities. This makes it possible to provide the laminate 100 having the metallic ink layer 2 of excellent glossiness that can suppress the diffuse reflection at the ink layer interface.

Further, because the smoothing ink is leveled, the smoothing ink layer 3 has reduced irregularities, and can further suppress the diffuse reflection at the ink layer interface.

The laminate 100 having the metallic ink layer 2 of excellent glossiness can be provided even when the medium 1 has large surface irregularities. The present invention can thus allow for use of various types of recording medium.

Second Embodiment

The laminate producing method according to the present invention is not limited to forming a laminate by laminating the ink layers in the order shown in FIG. 1A. For example, as shown in FIG. 1B, the present invention also encompasses a method in which a medium 11, a smoothing ink layer 13, a metallic ink layer 12, and a color ink layer 14 are laminated in this order to form a laminate 200. This embodiment describes such a method for producing the laminate 200. The same steps described in First Embodiment will not be described.

Smoothing Ink Layer Forming Step

The smoothing ink is applied onto the medium 11 to form the smoothing ink layer 13 before the metallic ink layer forming step (smoothing ink layer forming step I). In this step, the smoothing ink may be UV cured after being leveled.

Metallic Ink Layer Forming Step

The metallic ink is applied onto the smoothing ink layer 13 formed on the medium 11. The metallic ink is then UV cured to form the metallic ink layer 12. In this step, the metallic ink may be UV cured while being applied.

Because the metallic ink layer 12 is formed on the smoothing ink layer 13, the smoothing ink layer 13 provides a seal, preventing the metallic ink from permeating into the surface of the medium 11. Further, because the metallic ink layer 12 is formed on the smoothed surface of the smoothing ink layer 13, the metallic ink layer 12 has reduced surface irregularities.

Color Ink layer Forming Step

The color ink layer 14 is formed by applying the color ink onto the metallic ink layer 12 formed on the smoothing ink layer 13. This completes the laminate 200 having the medium 11, the smoothing ink layer 13, the metallic ink layer 12, and the color ink layer 14 laminated in this order as shown in FIG. 1B.

In the present embodiment, the metallic ink layer 12 formed on the smoothing ink layer 13 has reduced surface irregularities, and can suppress the diffuse reflection at the surface of the metallic ink layer 12. This makes it possible to provide a laminate having the metallic ink layer 12 of excellent glossiness.

Further, by leveling the smoothing ink, the metallic ink layer 12 formed on the smoothing ink layer 13 can have reduced irregularities, and can further suppress the diffuse reflection at the surface of the metallic ink layer 12.

Third Embodiment

The present invention also encompasses a method for producing a laminate 300 that includes a metallic ink layer 22 between two smoothing ink layers 23 and 25, as shown in FIG. 1C. In this embodiment, the smoothing ink layer 23 is formed on a medium 21 in a smoothing ink layer forming step I, and the smoothing ink layer 25 is formed on the metallic ink layer 22 in a smoothing ink layer forming step II. A color ink layer 24 is formed by applying the color ink onto the smoothing ink layer 25 formed on the metallic ink layer 22. This completes the laminate 300 having the medium 21, the smoothing ink layer 23, the metallic ink layer 22, the smoothing ink layer 25, and the color ink layer 24 laminated in this order as shown in FIG. 1C.

The laminate 300 includes the metallic ink layer 22 between the smoothing ink layers 23 and 25, and can suppress the diffuse reflection at the surface of the metallic ink layer 22 and at the ink layer interface. This makes it possible to provide the laminate 300 having the metallic ink layer 22 of excellent glossiness.

The present invention is not limited to the descriptions of the embodiments above, but may be altered in many ways within the scope of the claims. An embodiment based on a proper combination of technical means disclosed in different embodiments is encompassed in the technical scope of the present invention.

Additional Remarks

The laminate producing method according to First Embodiment of the present invention is a method for producing the laminate 100 by laminating the medium 1, the metallic ink layer 2 formed of a UV curable metallic ink containing metal particles, the smoothing ink layer 3 formed of a smoothing ink that smoothes the surface irregularities of the metallic ink layer 2, and the color ink layer 4 formed of the color ink, the method including the metallic ink layer forming step of applying the metallic ink onto the medium 1, and curing the applied metallic ink by irradiation of ultraviolet light and forming the metallic ink layer 2, the smoothing ink layer forming step II of forming the smoothing ink layer 3 by applying the smoothing ink onto the metallic ink layer 2 after the metallic ink layer forming step, and the color ink layer forming step of forming the color ink layer 4 by applying the color ink onto the smoothing ink layer 3.

In the smoothing ink layer forming step II, the smoothing ink is applied onto the metallic ink layer 2 to form the smoothing ink layer 3. The metallic ink layer 2 has surface irregularities before the smoothing ink application. However, the smoothing ink is applied to the surface in a manner that allows the smoothing ink layer 3 to fill the irregularities. Specifically, the smoothing ink layer 3 is provided between the irregular surface of the metallic ink layer 2 and the color ink layer 4, instead of providing the color ink layer 4 in direct contact with the surface of the metallic ink layer 2 having irregularities. This makes it possible to provide the laminate 100 having the metallic ink layer 2 of excellent glossiness that can suppress the diffuse reflection at the ink layer interface.

The laminate producing method according to Second Embodiment of the present invention is a method for producing the laminate 200 by laminating the medium 11, the metallic ink layer 12 formed of a UV curable metallic ink containing metal particles, the smoothing ink layer 13 formed of a smoothing ink that smoothes the surface irregularities of the medium 11, and the color ink layer 14 formed of the color ink, the method including the metallic ink layer forming step of applying the metallic ink onto the smoothing ink layer 13 formed on the medium 11, and curing the applied metallic ink by irradiation of ultraviolet light and forming the metallic ink layer 12, the smoothing ink layer forming step I of forming the smoothing ink layer 13 by applying the smoothing ink onto the medium 11 before the metallic ink layer forming step, and the color ink layer forming step of forming the color ink layer 14 by applying the color ink onto the metallic ink layer 12 formed on the smoothing ink layer 13.

In the smoothing ink layer forming step I, the smoothing ink is applied onto the medium 11 to form the smoothing ink layer 13. The metallic ink is then applied onto the smoothing ink layer 13 to form the metallic ink layer 12. Here, the metallic ink layer 12 is formed on the smoothing ink layer 13, and the smoothing ink layer 13 provides a seal, preventing the metallic ink from permeating into the surface of the medium 11. Further, because the metallic ink layer 12 is formed on the smoothed surface of the smoothing ink layer 13, the metallic ink layer 12 can have reduced surface irregularities. This makes it possible to provide the laminate 200 having the metallic ink layer 12 of excellent glossiness that can suppress the diffuse reflection at the surface of the metallic ink layer 12.

In the laminate producing methods according to First and Second Embodiments, the metallic ink in the metallic ink layer forming step is cured by irradiation of UV light while being applied.

The metallic ink layers 2 and 12 can be formed in a short time period by applying and curing the metallic ink at the same time.

In the laminate producing methods according to First and Second Embodiments, the metallic ink contains a solvent.

The solvent enables regulating the movement of the metal particles contained in the metallic ink, and forming thin metallic ink layers 2 and 12. Further, because of the high fluidity before the curing of the metallic ink, the metal particles orderly align themselves. This makes it possible to form metallic ink layers 2 and 12 of improved glossiness.

In the laminate producing methods according to First and Second Embodiments, the smoothing ink is UV curable, and the smoothing ink in the smoothing ink layer forming step I or the smoothing ink layer forming step II is cured by irradiation of UV light after being leveled.

By leveling the smoothing ink, the smoothing ink layers 3 and 13 can be formed that have reduced surface irregularities. The irregularities of the metallic ink layer 12 formed on the smoothing ink layer 13 formed in the smoothing ink layer forming step I also can be reduced to further suppress the diffuse reflection at the surface of the metallic ink layer 12. The smoothing ink layer 3 formed on the metallic ink layer 2 in the smoothing ink forming step II also has reduced irregularities, and can further suppress the diffuse reflection at the ink layer interface.

In the laminate producing methods according to First and Second Embodiments, the smoothing ink is a transparent clear ink.

With the use of a transparent clear ink, the color of the ink does not bleed even when left unattended. Further, the diffuse reflection at the surface of the smoothing ink layers 3 and 13 can be suppressed even more desirably.

In the laminate producing methods according to First and Second Embodiments, the smoothing ink preferably contains a solvent.

The solvent can improve the fluidity of the smoothing ink, and allows the smoothing ink to be easily applied to the medium 1 and 11, or the metallic ink layers 2 and 12.

The present invention is applicable to techniques for printing a glossy laminate on recording medium.

What is claimed is:

1. A method for producing a laminate by laminating a recording medium, a metallic ink layer formed of a UV curable metallic ink containing metal particles, a first smoothing ink layer formed of a smoothing ink that smoothes surface irregularities of the metallic ink layer, and a color ink layer formed of a color ink, and the method comprising:

a metallic ink layer forming step of applying the metallic ink over the recording medium and curing the metallic ink by irradiation of ultraviolet light;

a first smoothing ink layer forming step that forms the first smoothing ink layer that smoothes the surface irregularities of the metallic ink layer by applying the smoothing ink onto the metallic ink layer, wherein the smoothing ink is a transparent clear ink, is UV curable, and contains a solvent; and a color ink layer forming step of forming the color ink layer by applying the color ink onto the first smoothing ink layer, so as to produce a printed matter.

2. The method according to claim 1, wherein in the metallic ink layer forming step, the metallic ink is cured by irradiation of ultraviolet light while being applied.

3. The method according to claim 1, wherein the metallic ink contains a solvent.

4. The method according to claim 1, wherein in the first smoothing ink layer forming step, the smoothing ink is cured by irradiation of ultraviolet light after being leveled.

5. The method according to claim 1, further comprising:

a second smoothing ink layer forming step that forms a second smoothing ink layer that smoothes surface irregularities of the recording medium by applying the smoothing ink onto the recording medium before the metallic ink layer forming step wherein in the metallic ink layer forming step, the metallic ink is applied onto the second smoothing ink layer formed on the recording medium.

6. The method according to claim 5, wherein in the metallic ink layer forming step, the metallic ink is cured by irradiation of ultraviolet light while being applied.

7. The method according to claim 5, wherein the metallic ink contains a solvent.

8. The method according to claim 5, wherein in the first smoothing ink layer forming step or the second smoothing ink layer forming step, the smoothing ink is cured by irradiation of ultraviolet light after being leveled.

9. A method for producing a laminate by laminating a recording medium, a smoothing ink layer formed of a smoothing ink that smoothes surface irregularities of the recording medium, a metallic ink layer formed of a UV curable metallic ink containing metal particles, and a color ink layer formed of a color ink, and the method comprising:

a smoothing ink layer forming step that forms a smoothing ink layer that smoothes the surface irregularities of the recording medium by applying the smoothing ink onto the recording medium, wherein the smoothing ink is a transparent clear ink, is UV curable, and contains a solvent;

a metallic ink layer forming step of applying the metallic ink onto the smoothing ink layer and curing the metallic ink by irradiation of ultraviolet light; and a color ink layer forming step of forming the color ink layer by applying the color ink onto the metallic ink layer, so as to produce a printed matter.

10. The method according to claim 9, wherein in the metallic ink layer forming step, the metallic ink is cured by irradiation of ultraviolet light while being applied.

11. The method according to claim 9, wherein the metallic ink contains a solvent.

12. The method according to claim 9, wherein in the smoothing ink layer forming step, the smoothing ink is cured by irradiation of ultraviolet light after being leveled.

* * * * *